US005265388A

United States Patent [19]

Sherwood

[11] Patent Number: 5,265,388

[45] Date of Patent: Nov. 30, 1993

[54] SIMPLIFIED WINDOW ASSEMBLY

[76] Inventor: Kent Sherwood, 30081 Harvester Rd., Malibu, Calif. 90265

[21] Appl. No.: 853,449

[22] Filed: Mar. 18, 1992

[51] Int. Cl.[5] ..... E06B 3/54

[52] U.S. Cl. ..... 52/213; 52/764; 52/204.1; 52/204.5; 52/208

[58] Field of Search ..... 52/212, 211, 210, 202, 52/208, 213, 476, 764, 204.5, 204.56, 204.67, 204.68, 400

[56] References Cited

U.S. PATENT DOCUMENTS

| | | | |
|---|---|---|---|
| 975,719 | 11/1910 | Richardson | 52/476 |
| 1,092,727 | 4/1914 | Linder | 52/476 |
| 1,124,778 | 1/1915 | Meuler | 52/308 |
| 1,525,260 | 2/1925 | Anderson | 52/764 |
| 1,595,999 | 8/1926 | Coupland . | |
| 1,977,788 | 10/1934 | Allen | 52/764 |
| 2,191,660 | 2/1940 | Hirschey | 52/211 |
| 2,251,522 | 8/1941 | Nyberg | 52/764 |
| 2,386,151 | 10/1945 | Trautvetter | 52/213 |
| 2,683,293 | 7/1951 | Catalano | 52/764 |
| 2,710,431 | 6/1955 | Griffon | 52/210 |
| 2,761,535 | 9/1956 | Englehart | 52/476 |
| 3,037,589 | 6/1962 | Cole | 52/212 |
| 3,100,320 | 8/1963 | Frederick | 52/211 |
| 3,169,281 | 12/1960 | Clements, Jr. | 52/476 |
| 3,305,999 | 2/1967 | Bohn | 52/476 |
| 3,641,721 | 2/1972 | Martin | 52/212 |
| 3,969,857 | 7/1976 | Stark . | |
| 4,563,846 | 1/1986 | Webb | 52/213 |
| 4,780,998 | 11/1988 | Knapp | 52/211 |
| 4,873,803 | 10/1989 | Rundo | 52/202 |

FOREIGN PATENT DOCUMENTS

| | | | |
|---|---|---|---|
| 92014898 | 9/1992 | PCT Int'l Appl. | 52/213 |

*Primary Examiner*—Carl D. Friedman
*Assistant Examiner*—Winnie Yip
*Attorney, Agent, or Firm*—Arthur Freilich; Robert D. Hornbaker; Leon D. Rosen

[57] ABSTRACT

A window frame assembly is described which mounts a window pane (12, FIG. 2) in an opening (14) of a building wall, which minimizes the number of parts and their complexity. The assembly includes an outside frame (30) which surrounds an axis (34) of the wall opening, the outside frame having a radially outer part (40, FIG. 2) forming a flange that lies against the outside surface of the building wall, an inward arm (44) that extends inwardly against the edge (46) of the wall opening, and a radially inner part (42) that forms a window pane-supporting ledge (45). An inside frame (32) has a radially outer part (50) that lies against the inside surface of the building wall and an outward arm (52) that extends outwardly against a side of the inward arm, with the outer end (54) of the outward arm substantially abutting the window pane (12). The inner frame has a bridging part (70) that connects the radially outer part (50) of the inside frame to the outward arm (52) thereof, with the bridging part being free of connection to the outside frame to enable the bridging part to flex and allow the end of the outward arm to lie close to the window pane.

6 Claims, 2 Drawing Sheets

FIG. 1
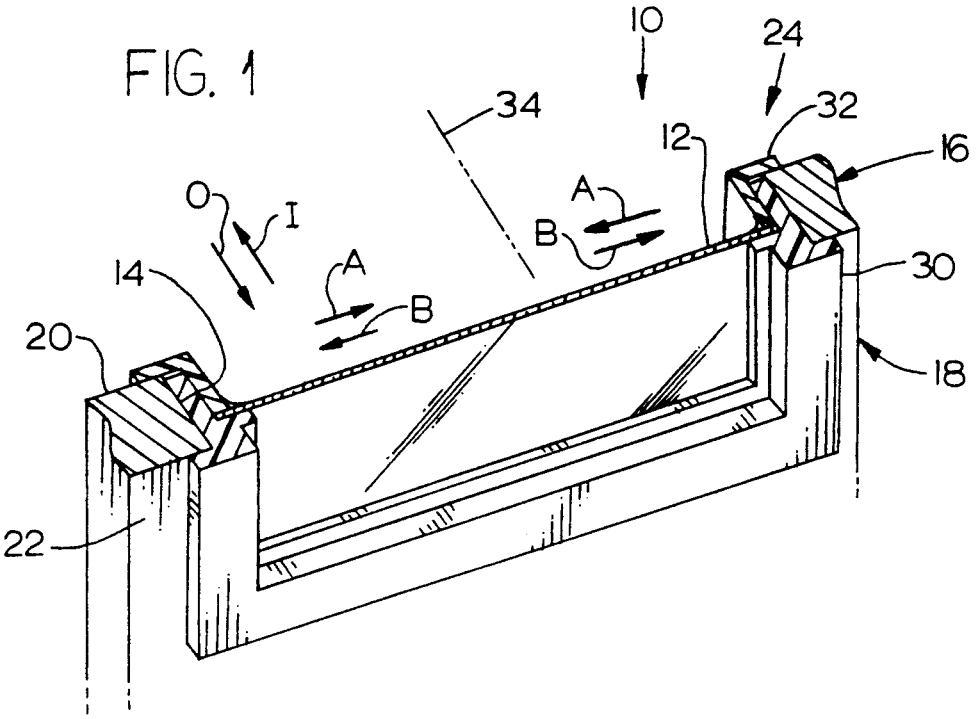
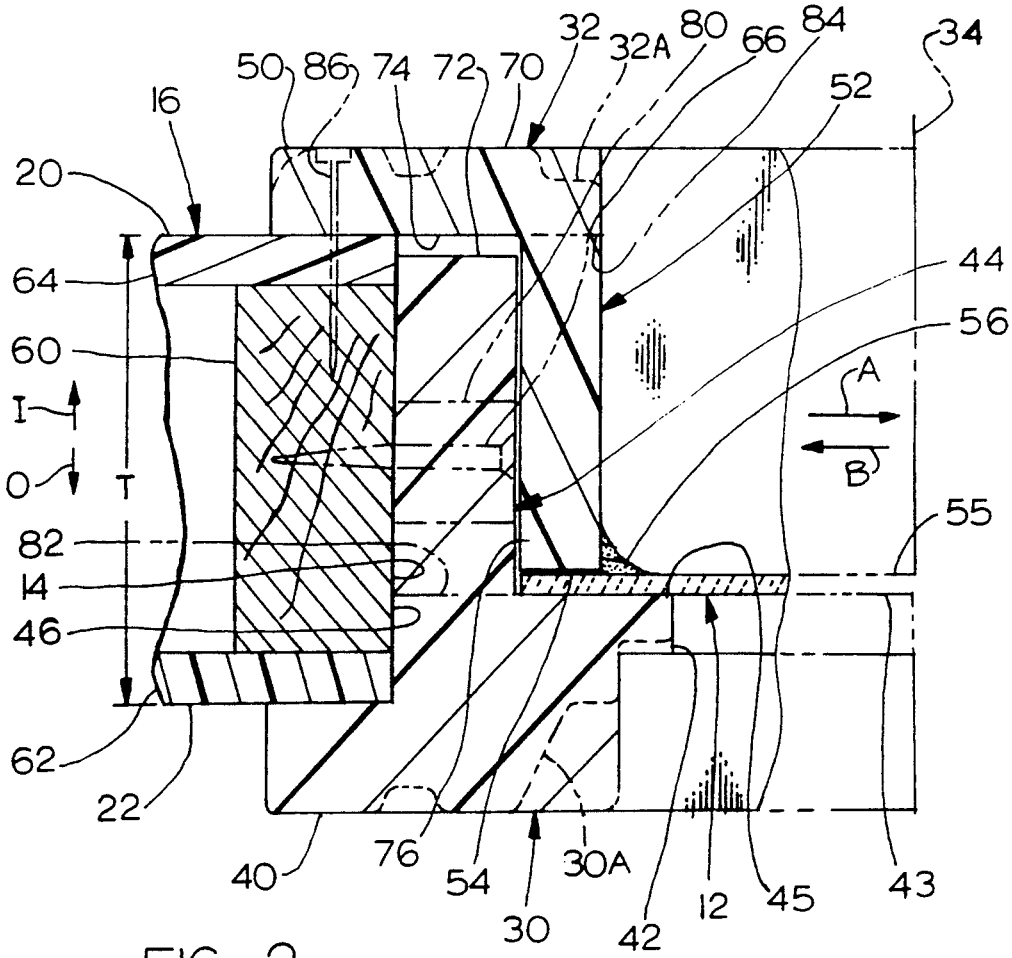
FIG. 2

SIMPLIFIED WINDOW ASSEMBLY

BACKGROUND OF THE INVENTION:

Window assemblies for mounting in the walls of buildings such as homes, often include several different parts that must be fastened to each other and/or the building wall. The use of several parts that each must be fastened results in considerable cost for the manufacture and transportation of the different parts, and in the time of craftsman in installing the parts. Also, the more parts that are used, the more likely that the installation will be defective in that it will leak or have a poor appearance, unless considerable care is exercised by the installer. The use of several parts is especially disadvantageous for round or oval windows because many window installers are used to working only with parts having straight sides. A window assembly which used a minimum number of parts which were of simple construction and which could be installed in a simple manner, could lower the cost and increase the average quality of window installations.

SUMMARY OF THE INVENTION

In accordance with one embodiment of the present invention, a window frame assembly is provided which uses a minimum number of simple and easily installed parts to hold a window pane within an opening formed in a building wall. The assembly includes outside and inside frames that have peripheral parts lying respectively against the outside surface and inside surface of the wall. The outer frame has an inward arm that extends inwardly adjacent to the edge of the wall opening, and has a radially inner part which forms a ledge for supporting the periphery of a window pane. The inside frame has an outward arm that extends outwardly beside the outward arm, with the outer end of the outward arm substantially abutting a window pane lying against the ledge on the outside frame.

The inside frame has a bridging part that connects the periphery that lies against the wall to the outward arm, the bridging part being free of connection to the outside frame, which enables the bridging part to flex. The outward arm can be attached to the edge of the wall opening, by fasteners extending radially through the outward arm into a stud or the like forming the middle of the wall opening. The inside and outside frames are preferably molded of plastic material, and can be molded to fit circular or oval openings as well as rectangular openings.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional isometric view of a window installation, constructed in accordance with one embodiment of the present invention.

FIG. 2 is a partial sectional view of the installation of FIG. 1.

DESCRIPTION OF THE PREFERRED EMBODIMENTS

Figure 3:
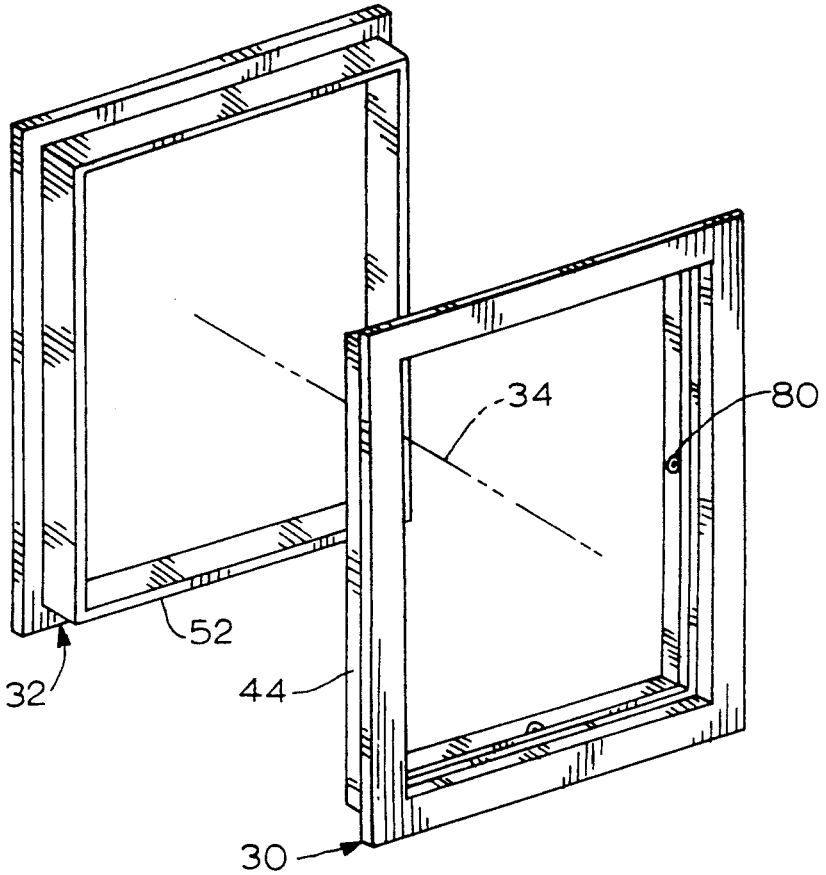
FIG. 3 is an exploded isometric view showing the outside and inside frames of the installation of FIG. 1.

FIG. 1 shows a window installation 10 wherein a window pane 12 is mounted within an opening 14 of an outer building wall 16 of a building 18. The wall has inner and outer surfaces 20, 22 respectively facing an inner room of the building and the outside environment. A window frame assembly 24 for mounting the window pane in the wall opening, includes outside and inside frames 30, 32 which mount on the wall and which securely hold the window pane 12 in place. The wall opening 14 may be considered to have an axis 34 which extends in inward and outward directions indicated by arrows I and O. These directions I, O may be considered to be axial inner and outer directions, in that they are parallel to the axis 34 of the wall opening. Directions generally toward or away from the axis 34 (or away or toward the peripheries of the frames), may be considered to be radial inward and outward directions indicated by arrows A and B.

As shown in FIG. 2, the outside frame 30 has a radially outer part, or peripheral part 40 which forms a wall-mount flange that lies substantially against the outer surface 22 of the wall (but which may not be directly attached to the wall). The outside frame has a radially inner part 42 which forms a pane-support ledge 45 facing in an axially inward direction I to support the outer surface 43 of the peripheral portion of the window pane 12. The outer frame 30 also has an inward arm 44 which extends in an axially inward direction I, to extend inwardly into the wall opening, with the inward arm 44 lying adjacent to the edge 46 of the wall opening 14.

The inside frame 32 has a radially outer part or peripheral part 50 forming a wall mount flange which lies substantially against the inner surface 20 of the wall 16. The inside frame 32 also has an outward arm 52 that extends in an axially outward direction 0 and which lies radially inward but adjacent to the inward arm 44 of the outside frame. The outward arm 52 has an outer end 54 which substantially abuts a peripheral portion of the window pane 12 at the pane inner surface 55, so the window pane is essentially clamped between the surfaces 44, 54. In many situations, a caulking 56 will be applied as shown, to seal out even small air currents.

The wall 16 may have a number of different constructions, but is preferably formed with a wood stud 60 along each of the four sides of the opening for structural support, and with outer and inner drywall sheets 62, 64. The drywall sheets cover the stud and spaces between adjacent studs (which may be filled with insulation or left empty). The inside and outside frames can be attached by nails or the like passing through their flanges 40, 50 and through the drywall sheets into the stud 60. However, applicant prefers to attach at least the outside frame 30 to the wall by fasteners such as wood screws 66 that project in radially outward directions B through holes in the inward arm 44 and into the wood stud 60. The advantage of such holding is that the wood screws are not exposed to the weather so they do not corrode or heavily oxidize as rapidly as those exposed to the weather. Also, the screws are not seen from the outside of the building and therefore can enhance the appearance, especially where a lacquer finish or the like is applied instead of a heavy paint coating.

The inside frame 32 includes a bridging part 70 that connects the radially outer part or flange 50 to the outward arm 52. The bridging part 70 is not connected to the inward arm 44, which allows the bridging part 70 to flex slightly. This enables the axially outer end 54 of the outward arm 52 to move slightly axially inwardly and outwardly (in directions I, O) to firmly abut the window pane 12, where possible, while the flange 50 lies substantially flat against the wall inside surface 20. This can be accomplished by cutting away part of the end portion 76 of the outward arm 52 until it fits as described above. The arms 44, 52 lie in a slip fit, in that they do not have any axially-facing shoulders that abut each other. The inward arm 44 has an axially inner end 72 that is preferably short enough to leave a gap 74 between the bridging part 70 and the inward arm end 72.

The outside and inside frames 30, 32 are preferably molded, as by injection or cast molding, and may be constructed of a moldable plastic (polymer) such as a high density polyurethane foam. The inserts 80 can be molded into the outside frame. This can result in frames that are uniform from one to the another, to assure rapid installation in wall openings that are accurately formed. The axially outer end portion 76 of the outward arm is preferably of uniform cross section, so that the arm end can be trimmed to assure good fit of the outer end 54 against or substantially against the window pane 12, without affecting appearance.

The construction of the wall 16 shown in FIG. 2, is commonly used in modern homes. However, it is possible for the thickness T of the wall to vary as where slightly different thicknesses of drywall sheets 62, 64 are used, or an outside siding lies over the outer wall surface, or where the home is an older one which does not conform to more modern practice. The ability to trim the end of the outward arm 52 facilitates fitting of the frame assembly to a variety of walls. The outward arm of the inside frame can be trimmed in a number of ways, such as by use of a planer, or a saber saw which is guided by the periphery of the wall mount flange.

The material out of which the outside and inside frames are molded, is preferably of low cost, and therefore may not have especially high strength and rigidity. Applicant prefers to provide several inserts 80, such as four of them (for smaller or round windows) which are of harder material than the rest of the outside frame 30 (e.g. of wood as compared to polyurethane foam). Each of the inserts 80 may have a predrilled hole for receiving the wood screw 66, although a hole can be drilled therein by the installer. It may be noted that the outside and inside frames may be provided with recesses and grooves to enhance their appearance, and the shapes shown at 30A and 32A indicate specific examples of decorative frames. Applicant prefers to construct the inward arm 44 (the part extending axially inwardly of the imaginary line 82 which is an extension of the ledge 44) and the outward arm 52 (that portion of the inside frame extending axially outward of the line 84 which is an extension of the bridging part 70) so both are of elongated rectangular shape.

To make the installation, the builder of the wall preferably leaves the opening 14 as shown, with a wood stud 60 forming the middle of the edge 46. An installer can first place the outside frame against the outer surface 22 of the wall as shown, and then install the wood screws 66. The installer, working from the inside of the building, places the window pane 12 as shown, and then places the inside frame 32 as shown, and fastens the inside frame in place, as by means of finishing nails indicated at 86 which project through the flange 50 of the inside frame and through the drywall sheet 64 into the stud 60. Where desired, a caulking 56 may be added. The cross section of the frames is substantially the same around the entire edge of the window opening.

Figure 4:
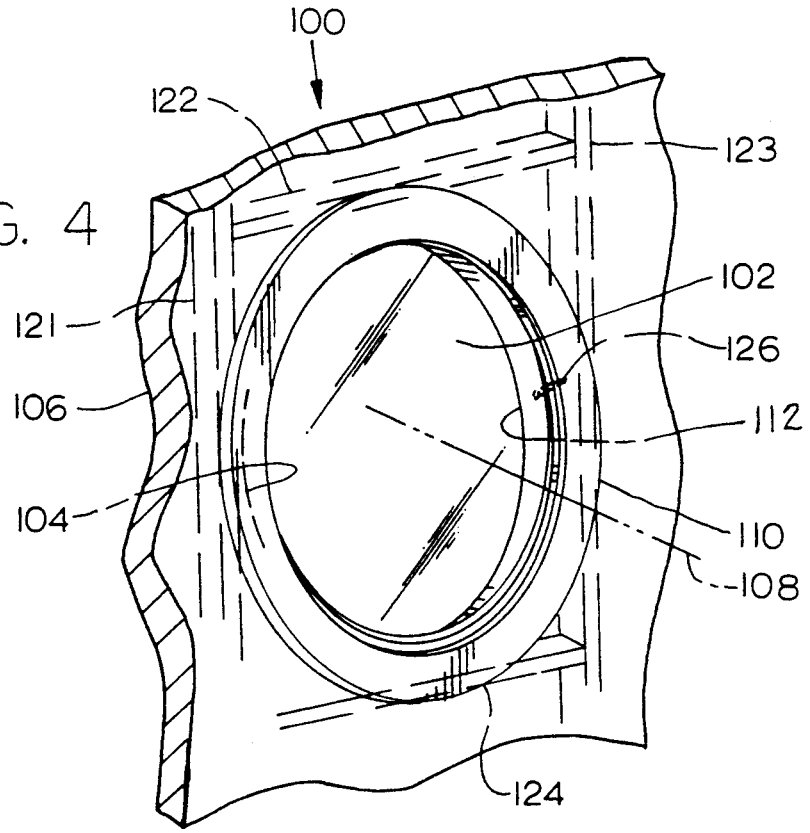
FIG. 4 is an isometric view of another embodiment of the invention, wherein the window opening and window pane are of circular shape.

FIG. 4 illustrates a window installation 100 wherein a window pane 102 with a round periphery centered on axis 108, lies within a round opening 104 in a building wall 106. The installation includes outside and inside frames 110, 112 which have cross sections substantially identical to that shown in FIG. 2, but which are curved to follow the circular wall opening. The wall opening can be formed in a number of ways, as by four studs indicated at 121–124, with screws 126 holding four locations on the outer frame to the stud.

Thus, the invention provides a window frame assembly for mounting a window pane in a building wall opening, which is of simple construction and which allows rapid installation with good uniformity. The assembly includes outer and inner frames that have peripheral portions lying respectively over outer and inner surface of a building wall, just beyond a wall opening. The outside frame has an inward arm that extends axially inwardly immediately within the wall opening and has an inwardly-facing ledge for supporting the periphery of a window pane. The inside frame has an outward arm that extends axially outwardly and lies adjacent to the inward wall of the outside frame in a sliding fit therewith, so the inward arm is sandwiched between the outward wall and the edge of the wall opening. The axially outward end of the outward arm lies substantially against, and preferably firmly against, the periphery of the window frame to hold it against the ledge of the outside frame. The inside frame includes a bridging part that bridges the flange and outward arm, with the bridging part being free to deflect slightly. The frames are preferably molded, and inserts of harder material than the molded material can be used to hold screws, nails, or other elongated fasteners that project through the inward arm into a stud or the like forming the edge of the wall opening.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A window installation, comprising:

a building outer wall having an opening with an axis and an opening edge, and having inner and outer surfaces facing respectively into said building and out into the environment surrounding the building;

a one-piece outside frame extending about said opening edge and attached to said wall, said outside frame having an inward arm lying within and substantially against said opening edge and extending axially inwardly along said wall edge, said outside frame having a wall mount lying substantially against said outer surface of said wall immediately around said opening, and said outside frame forming an axially inwardly facing pane support ledge lying further from said opening edge than said inward arm;

a window pane lying in said opening and having an outer pane surface lying against said pane support ledge and having an inner pane surface;

a one-piece inside frame extending about said opening edge, said inside frame having an outward arm lying on a side of said inward arm opposite said opening edge and having an end substantially abutting said inner pane surface, said inside frame having a wall mount lying substantially against said inner surface of said wall immediately around said opening;

a first plurality of fasteners each extending only through said inward arm into said opening edge, to retain said outside frame to said building wall independently of said inside frame;

a second plurality of fasteners attaching said inside frame to said building wall.

2. The assembly described in claim 1 wherein:

said inward arm has a substantially rectangular cross section with its radially outer surface lying flat against said opening inner edge along substantially the entire length of said inward arm, and said outward arm has a substantially straight radially outer surface that lies flat against said inward arm along substantially the entire length of said inward arm, substantially completely about said opening.

3. The assembly described in claim 1 wherein:

said wall includes a wood stud that forms the middle of said wall opening, and a pair of drywall sheets that lie at axially inward and outward ends of said stud, and said first plurality of fasteners project primarily perpendicular to said opening axis through only said inward arm and into said stud.

4. An assembly which supports a window pane in an opening of a building wall, wherein the building wall has an opening edge and inner and outer wall surfaces, wherein the assembly has inner and outer frames that have mount parts that lie respectively against said inner and outer wall surfaces, with a first of said inner and outer frames having a pane-supporting ledge that supports a peripheral portion of the window pane, characterized by:

said first frame has a first arm that extends along said wall edge and which lies between the mount part of said first frame and the pane-supporting ledge thereof;

a second of said inner and outer frames has a second arm that lies beside but in a slip fit with said first arm, with an end of said second arm substantially abutting said window pane, said first and second frames each being mounted on said building wall; and including a plurality of elongated fasteners each projecting through only said first arm into said edge of said building wall opening.

5. The assembly described in claim 4 wherein:

said first frame is molded of a lightweight material, but includes a plurality of inserts of harder material than said lightweight material lying in said first arm, with each insert constructed to receive one of said elongated fasteners in passage therethrough and into said building wall edge.

6. A window frame assembly for mounting a window pane in an opening formed in a wall that has inner and outer surfaces, where said wall forms an opening edge which is elongated in a direction extending around said opening, comprising:

an outside frame for mounting on said wall, said outside frame having an axis extending in axially inward and outward directions and having a radially outer part forming a wall-mount flange for lying substantially against the outer surface of the wall, a radially inner part forming a pane-support ledge, and an inward arm lying radially between said inner and outer parts for extending in an axially inward direction into said wall opening;

an inside frame mounted on said wall, said inside frame having a radially outer part forming a wall mount flange for lying substantially against the inner surface of the wall, and having an outward arm for extending directly axially outwardly into said wall opening, said outward arm lying radially inward of, and adjacent to, said inward arm, and said outward arm having an outer end lying adjacent to said pane-support ledge to substantially sandwich a window pane between them;

said outward arm is of substantially constant radial thickness, to facilitate cutting away of said outward end portion to assure that its extreme axially outward end lies adjacent to the window pane, and said outward arm is formed of a material that is at least as easy to saw as wood.

* * * * *